United States Patent [19]

Romagnoli

[11] Patent Number: 4,885,896

[45] Date of Patent: Dec. 12, 1989

[54] APPARATUS FOR COLLATING DUAL-USE FILTER SACHETS ARRANGED IN THE NON-CONSUMER MODE IN MACHINES FOR THE CONTINUOUS PRODUCTION OF SAID FILTER SACHETS

[75] Inventor: Andrea Romagnoli, San Lazzaro Di Savena, Italy

[73] Assignee: Cestind - Centro Studi Industriali - S.r.l., San Pietro Terme, Italy

[21] Appl. No.: 154,650

[22] Filed: Feb. 10, 1988

[30] Foreign Application Priority Data

Mar. 9, 1987 [IT] Italy ..... 3380 A/87

[51] Int. Cl.[4] ..... B65B 29/04

[52] U.S. Cl. ..... 53/116; 53/134; 53/520

[58] Field of Search ..... 53/117, 116, 520, 134, 53/128, 413, 410, 234, 232; 493/226, 231, 375, 345, 926

[56] References Cited

U.S. PATENT DOCUMENTS 2,823,502 2/1958 Rambold ..... 53/134
3,192,683 7/1965 Grafingholt et al. ..... 53/134
3,774,369 11/1973 Klar ..... 53/134
3,805,483 4/1974 Romagnoli ..... 53/134

FOREIGN PATENT DOCUMENTS 2170777 8/1986 United Kingdom .

*Primary Examiner*—James F. Coan
*Attorney, Agent, or Firm*—Herbert Dubno

[57] ABSTRACT

An apparatus for collating dual-use filter sachets obtained from a flattened tube of thermally weldable filter paper comprising multiple bags or pouches defined by transverse thermal welds in continuously operating production machines and provided with labels, threads and tabs for attachment of the matter. The apparatus has a cutter for cutting up the tube, into portions having at least two pouches, across the attachment tabs. A device then folds in bellows-shape, these portions along the intermediate transverse thermal weld and operates in combination with a device having conveying pincers for conveying the folded bags to a pickup and transfer device through a fixed folder so as to set up the pouches back to back transferring them as thus folded to a welder for welding together the thus adjoining extremists thereof.

4 Claims, 4 Drawing Sheets

FIG. 4A
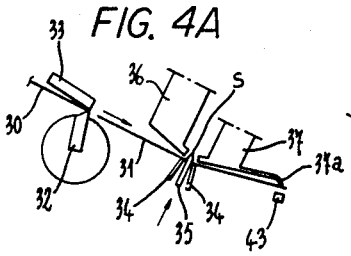
FIG. 4B
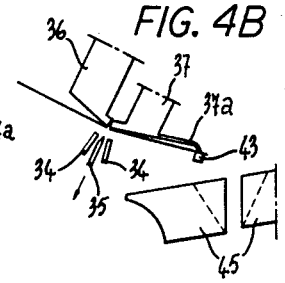
FIG. 4C
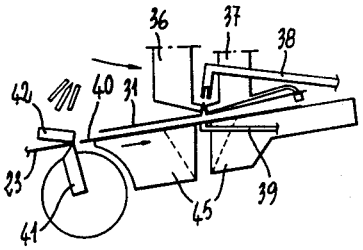
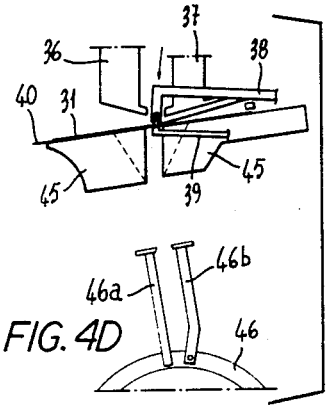
FIG. 4D
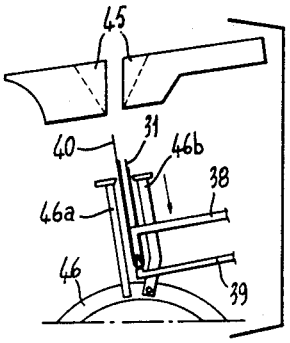
FIG. 4E
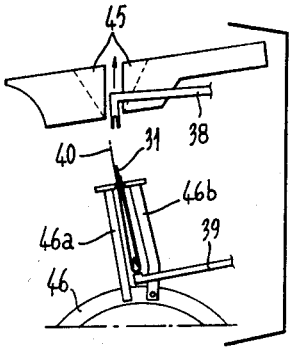
FIG. 4F
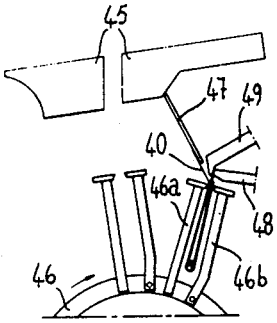
FIG. 4G
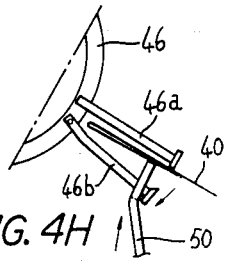
FIG. 4H
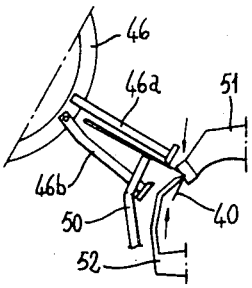
FIG. 4I
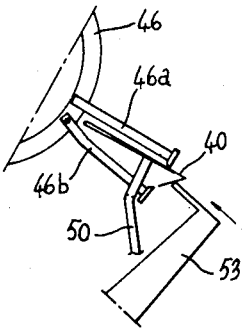
FIG. 4L
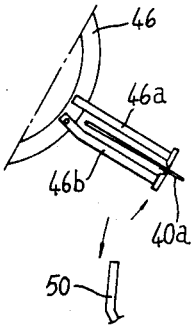
FIG. 4M

APPARATUS FOR COLLATING DUAL-USE FILTER SACHETS ARRANGED IN THE NON-CONSUMER MODE IN MACHINES FOR THE CONTINUOUS PRODUCTION OF SAID FILTER SACHETS

FIELD OF THE INVENTION

My present invention relates to an apparatus for collating filter sachets in a machine for the continuous production of the dual-use filter sachets.

BACKGROUND OF THE INVENTION

From the Italian patent application No. 3376 A/87 and the corresponding copending U.S. application Ser. No. 07/154,782 filed concurrently herewith, an automatic machine is known for the continuous production of dual-use filter sachets for infusion products with bags or pouches in succession containing fractional doses of the infusion product.

The machine comprises along its production line succession of effecting successive steps in the production of such filter bags.

At the upstream end of the path there is a means for progressively folding and longitudinally sealing a strip of thermally weldable filter paper fed with the fractional doses of the infusion product into a horizontally oriented flattened tubular form and for thermally welding the tube transversely so as to enclose the individual fractional doses between two of the transverse thermal welds.

Downstream therefrom along the path is a further rotary wheel means with pickup elements for applying to the flattened tube equidistantially spaced labels as well as a continuous longitudinal thread transversely contacting the labels and stickers or tabls of thermally weldable material across the alternate transverse thermal welds partly to the back of the labels.

Further downstream is a means for cutting up the tube thus conformed into portions comprising at least two bags and for setting these up to back on each other and for sealing together their extremities.

More particularly, such a dual-use sachet of filter papers with multiple successive or serial bags or pouches, each containing a fractional dose or unit quantity of the infusion product, has a structure allowing two modes of use, namely one (nonconsumer made) in the flattened shape collated in lots for sale with the bags or pouches in a superimposed or adjacently set arrangement with one bag or pouch located or folded over the other, and one with an unfolded or extended arrangement of the pouches following pressing and pulling of the corresponding label located over the handling thread of the filter sachet by the user. The length of the thread is substantially equal to the length of the sachet in the unfolded arrangement of its bags or pouches and is fastened to the opposite extremity of the sachet by means of a sticker or tab made of thermally weldable material jointly with the label made of a not thermally weldable paper in proximity to one of these opposite extremities and is arranged to lie longitudinally along the outside of the sachet when the bags or pouches are in their collated arrangement in lots for sale, with the folded-back pouches backing against each other.

OBJECT OF THE INVENTION

The object of the present invention is to provide an improved apparatus for collating or stacking dual-use filter sachets arranged in the nonconsumer mode.

SUMMARY OF THE INVENTION

According to the invention the filter sachets are obtained from a flattened tube of thermally weldable filter paper with multiple discrete bags or pouches arranged in series by transverse thermal welding in the machine for continuously producing said dual-use filter sachets with the labels arranged spaced from the transverse median line of the alternate transverse thermal welds, with a continuous longitudinal thread transversely contacting said labels and stickers or tabs of thermally weldable material for attaching said thread across these alternate transverse thermal welds partly to the back of the labels.

According to the invention the collating or stacking apparatus comprises cutting means for cutting said tube, thus fitted with labels, thread and thermally weldable tabs, into portions having at least two bags or pouches, across the fastening tabs in accordance with the aforesaid median transverse line of the alternate transverse thermal welds, and folding means capable of folding these portions into a bellows-shape at the intermediate transverse thermal welds in combination with means having conveying pincer elements capable of seizing the part folded in bellows-shape of these portions and to convey the latter to holding elements associated with this part thus folded in bellows-shape and for transferring same through fixed folding means with a hopper so as to fold back the opposite sides of this part folded into bellow shape, backing up said pouches and transferring the said portions thus folded with backed-up pouches to welding means capable of welding together the respective adjacent opposing extremities in association with the aforesaid thermally weldable tabs.

BRIEF DESCRIPTION OF THE DRAWING

The above and other objects, features and advantages of may invention will become more readily apparent from the following description, reference being made to the accompanying highly diagrammatic drawing in which:

FIGS. 4A–4M show diagrammatically the production line in its operational details regarding the apparatus according to the invention.

SPECIFIC DESCRIPTION

Figure 1:
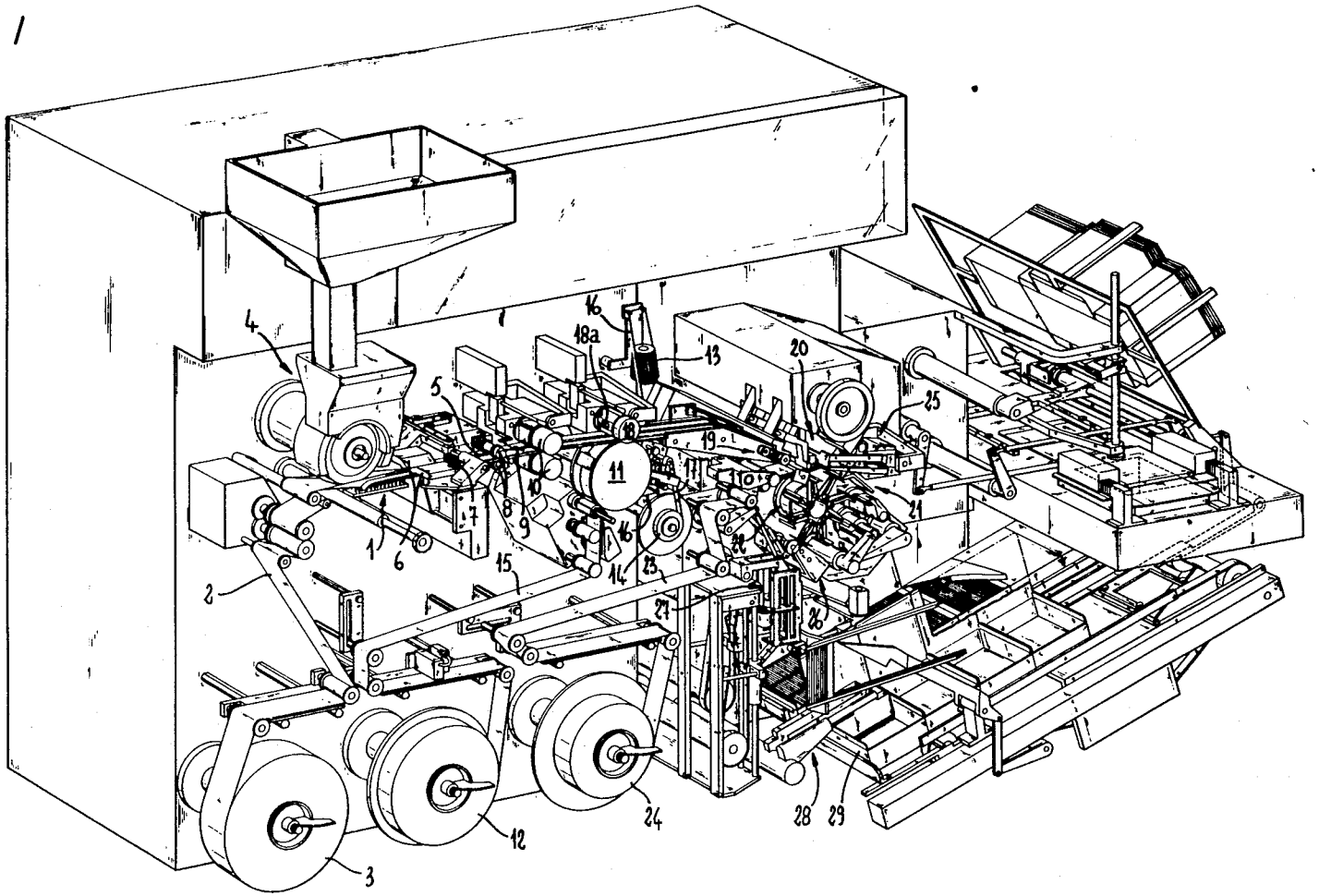
FIG. 1 is a front side perspective view of the production machine fitted with the apparatus according to the invention.

The production machine shown in FIG. 1 is that which has been described and claimed in the aforecited Italian Patent Application No. 3376 A/87 and U.S. application Ser. No. 07/154,782, employing the apparatus according to the present invention and shown with its integrated production line.

The apparatus is used for the continuous formation of dual-use filter sachets with successively or serially arranged multiple bags or pouches each containing a fractional dose of the infusion product, folded back and set up back to back and provided with label and thread for their handling by the user with the bags being in the extended arrangement, one following the other, and means for the packing of the individual filter sachets in outer envelopes and collating the said filter sachets thus packed into cartons or boxes for storage and sale.

The said integrated production line of the said machine is essentially defined by a succession of means which effect the continuous production of the dual-use filter sachets.

The line thus includes means 1 for supporting and folding into a substantially flattened tubular form a strip 2 of thermally weldable filter paper in continuous motion in substantially horizontal orientation.

Downstream thereof is a feeder-dosing means 4 for feeding equidistantly spaced fractional doses of the infusion product onto and along the said continuously moving strip of thermally weldable filter papers 2 as it is being folded by the folding means 1 into said substantially flattened tubular form, with the longitudinal edges of said strip 2 in vertically oriented mutual contact to form a longitudinal crest 5. A multipleaction welding means 6 thermally welds the vertically oriented mutually contacting edges forming the longitudinal crest 5.

Knurling rollers 7 operating on the longitudinal crest 5 seal the same by the knurling action.

Means 8 with transversely spaced rollers and counter-rollers operates laterally relative to said sealed and knurled longitudinal crest on said continuously moving strip of filter paper in its substantially flattened tubular form for entraining the strip while maintaining and enhancing its flattening.

A leaf spring 9 forms folding means capable of laterally folding back said welded and knurled longitudinal crest 5 on said strip of filter paper in its flattened tubular form.

A means 10 with welding rollers and counter-rollers is capable of thermally welding transversely the continuously moving strip of filter paper in its substantially flattened tubular form between said fractional doses of infusion material so as to enclose said fractional doses between successive transverse thermal welds. Rotating wheels or heads 11 are provided with pickup elements for infeeding, from respective reels 12, 13, 14 underneath of and in contact with the strip of filter paper in continuous movement and flattened tubular form, a succession of labels cut from strip 15 of reel 12. Each of the labels are arranged with spacing relative to the median transverse line of the alternate transverse thermal welds. This device also feeds a continuous longitudinal thread 16 from the corresponding reel 13 transversely contacting the outer surface of the said succession of labels and further a succession of stickers or tabs cut from strip 17 of reel 14, made of thermally weldable material, applying same across the alternate transverse thermal welds partly to the back of the labels.

Roller means 18 has elements having peripherally equidistant thermal pressure pads capable of cooperating in counter-rotation with the aid means having rotating wheels or heads 11 with pickup elements so as to thermally weld, with the aid of the thermal pressure pad elements, the said stickers or tabs of thermally weldable material to the thread and the latter to the labels while welding the thread to the continuously moving strip of filter paper in its flattened tubular form across the alternate transverse thermal welds.

Cutting means 19 is capable of cutting up the continuously moving strip of filter paper in the flattened tubular form thus provided with labels, longitudinal thread and thermally weldable stickers or tabs, along the aforesaid transverse median line of the alternate transverse thermal welds, into portions or segments comprising at least two successive bags or pouches each.

Folding and conveyor means 20 are capable of re-folding and conveying portions or segments of the strip of filter paper in flattened tubular form with at least two bags or pouches relative to the median line of the corresponding transverse thermal weld so as to superimpose on each other or to set up the bags back to back.

Thermal welding means 21 are provided along the production path for joining by thermal welding the respectively resulting transverse terminal edges there adjacent with the aid as well of the corresponding stickers or tabs made of thermally weldable material.

A rotary wheel 22 with radial pincers cooperating with a means for infeeding and for folding into the shape of a V portions of paper cut from a strip 23 on a reel 24.

The means 25 serves for transferring the filter sachets from the prongs of the V-folded paper portions and then transferring the portions of paper folded in the shape of a V with insertion of the corresponding filter sachets between the radial pincers of the rotating wheel 22.

A means 26 is provided for sealing the edges of said portions folded into the shape of a V to form containment packs of the corresponding filter sachets.

The means 27 then stacks these packs and while a means 28 transfers the resulting stacks into cartons or boxes 29 previously made up.

Figures 3, 3A:
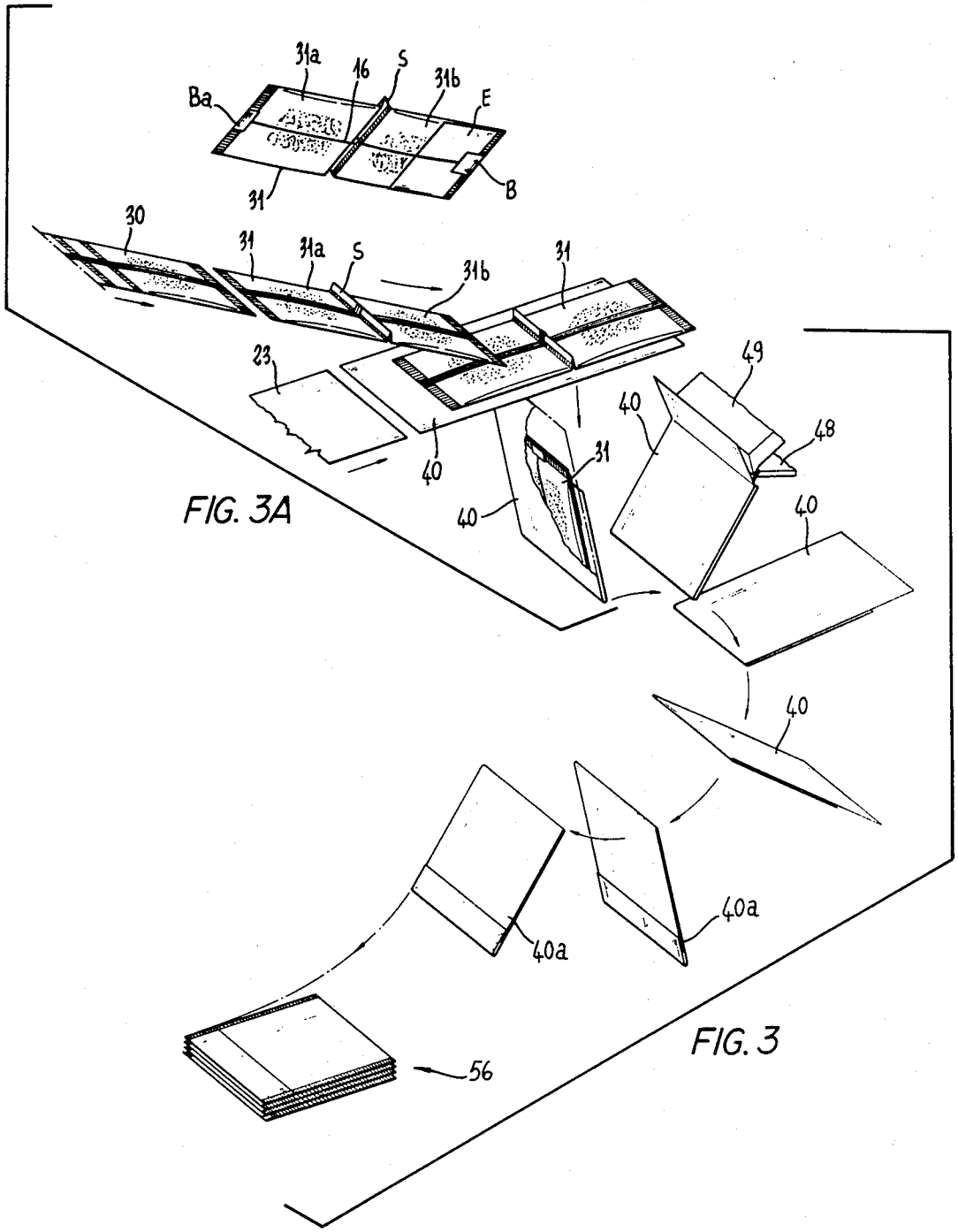
FIG. 3 is an even more enlarged perspective front-side elevation, showing the succession of operations carried out by the apparatus on the product.
FIG. 3A is a perspective detail of FIG. 3.

As stated above, the apparatus of the invention is intended for collating dual-use filter sachets arranged, as produced with folded bags or pouches backing against each other, in the non-consumer mode, in automatic machines for the production of the filter sachets and, more particularly, an apparatus designed to cut up the continuously moving strip 30 of the filter paper in the flattened tubular form (see FIG. 3), thus provided with labels E, longitudinal thread 16 and thermally weldable stickers or tabs B, in the direction of the aforesaid transverse median line of the said alternate transverse thermal welds, into portions or segments 31 comprising at least two bags or pouches successively (see FIGS. 3 and 3A), re-folding and conveying said portions of segments 31 of strip 30 relative to the median line of the corresponding intermediate transverse thermal weld so as to superimpose these bags or pouches or set them up back to back and to join, by means of thermal welding, the resulting adjacent terminal edges with the further aid of the corresponding half-stickers or half-tabls B and Ba of the thermally weldable material (see again FIGS. 3 and 3A).

Figure 2:
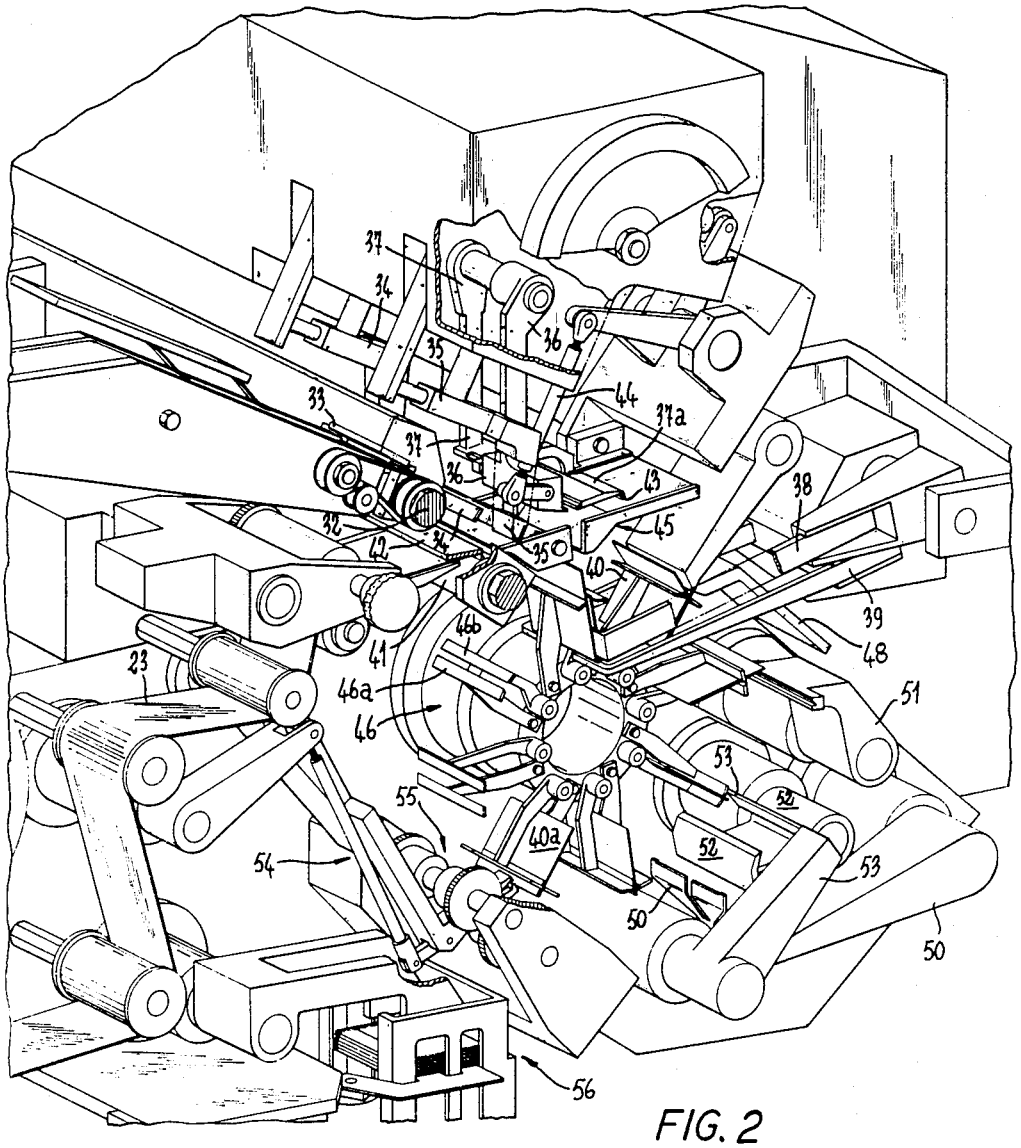
FIG. 2 is a perspective front-side elevation on an enlarged scale of that part of the machine which involves the apparatus according to the invention.

Referring now in particular to FIGS. 2 and 4, it can be seen that such an apparatus according to the invention comprises a rotary knife 32 and a fixed knife 33 for cutting, across the tabs B, the strip 30 into the portions 31 each comprising two bags or pouches 31*a* and 31*b* (see FIGS. 4A and 3A) having on their opposite extremities corresponding half-tabs B and Ba. Mobile folding means 34 and 35 are capable of re-folding each cut segment into a bellows-shape S in the directionof the intermediate transverse thermal welds in combination with means having conveying pincers 36 and 37 capable of seizing the part folded in bellow-shape S of the said portions 31 (see FIGS. 4A and 4B).

The pincers convey the folded part between holding means 38 and 39 onto a portion of enveloping paper 40 cut by means of a rotary knife 41 and a stationary knife 42, from the paper strip 23 supplied by reel 24.

This transfer of the portions 31 by the said pincer means 36 and 37 also involves cooperation with an extension part 37*a* carried by pincer means 37 and a mobile element 43 actuated by a lever 44 (see FIGS. 2 and 4A, 4B and 4C).

The arrangement of said portion 31 on the underlying portion of paper 40 is such that the portion 31 protrudes from the paper with its downstream extremity in the direction of movement of its transfer, while the upstream extremity of this paper portion 40 projects relative to the trailing extremity of this portion 31.

An assembly of portion 31 and portion 40 of this kind is seized by the aforesaid pickup means 38 and 39 in registration with the portion folded in bellows-shape (FIG. 4D) and, after causing it to pass through stationary folding means formed by funnel 45 so as to refold the portion 31 on the opposite sides of its part folded in bellows-shape S together with portion 40, transfers the assembly folded in U-shaped between the prongs 46*a* and 46*b* of an intermittently moving pincer wheel 46. The pincer 46*a* is stationary and the pincer 46*b* is movable. The projecting extremity of the paper strip protrudes with the respective terminal parts of the bag folded in a U-shape from the prongs 46*a* and 46*b* (see FIG. 4E). In this instant, while the prongs 46*a* and 46*b* maintain the above-mentioned U-shaped arrangement, the aforesaid pincer means 38 and 39 are caused to return into their initial open position and the wheel 46 rotates by one step (FIG. 4G). In the course of this one-step displacement, a deflector 47 causes the longer terminal edge of portion 40 to more away from the portion 31, so as to enable the stationary and mobile welding means 48 and 49, respectively to weld together the opposite extremities of the portion 31 again with the aid of the aforesaid thermally weldable half-tabs B and Ba (see again FIG. 4G).

Following this welding operation, the wheel 46 rotates by another step into a rest position and thereafter executes a further step (FIG. 4H). In the position of FIG. 4H, a collating lever 50 maintains in position the assembly of portion 31 and portion 40, so as to enable the opening of the prong 46*b* to allow the levers 51 and 52 to fold back the terminal part of portion 40 in the form of a packing closure border of portion 40 (FIG. 41) and to allow the lever 53 to fold back this closure border against the same portion 40 folded in pack 40*a* (FIG. 4M). By the further rotations with successive steps of wheel 46*a*, the sachet-pack assembly is moved to register with a system of pickup levers 54 where it is seized, passed between knurling rollers 55 for peripheral sealing of the assembly and hence deposited in a collecting and stacking tray 56 for subsequent handling and packaging for sale.

I claim:

1. An apparatus for making infusion packets comprising:

means for feeding a strip of thermally weldable filter paper along a transport path;

means along said path for feeding successive measured quantities of an infusion product onto said strip;

means along said path for folding said strip into a flattened tube, formed with separating and folding transverse thermal welds alternating with one another and each having a transverse median line, said transverse welds flanking said quantities of said infusion product on said strip, and defining individual bags each containing a measured quantity of said infusion product;

means along said path for applying labels, tabs and strings to said strip;

means for severing segments of said strip from one another along the separating transverse welds to form respective segments each comprising at least two of said bags joined by the respective folding weld, each of said segments being formed with a respective leading extremity and a respective trailing extremity;

folding means downstream of said path for forming bellows-shape portions of the respective segments along the respective folding transverse weld thereof;

conveying pincer means for seizing said bellows-shape portions and for conveying said segment further along the path;

stationary folding means provided with a funnel for bringing bags of the respective segment toward each other, so that said bags of the respective segment are folded against opposite sides of said bellows-shape portion with said leading and trailing extremities adjacent to each other, and welding means for receiving said segments with folded bags and for welding together said adjacent leading and trailing extremities.

2. The apparatus defined in claim 1 wherein said folding means include a pair of collating bars juxtaposed with said conveyor pincer means and a folding bar movable between said bars and said conveyor pincer means.

3. The apparatus defined in claim 1, further comprising mobile means operatively connected with said conveyor pincer means for moving the later into contact with the respective bellows-shape portion of the respective segment.

4. The apparatus defined in claim 3 wherein said conveyor pincer means are formed with an extension part cooperating with said mobile means for supporting the respective leading extremity of the respective segment upon advancing the latter along the path.

* * * * *